United States Patent [19]

Lupoli et al.

[11] Patent Number: 4,727,239

[45] **Date of Patent: * Feb. 23, 1988**

[54] PLUG HAVING ENCAPSULATED THERMAL SENSOR, FOR ENGINE BLOCK HEATER

[75] Inventors: Peter J. Lupoli, Hamden; Donald J. Mattis, Norwalk, both of Conn.

[73] Assignee: Casco Products Corporation, Bridgeport, Conn.

[ * ] Notice: The portion of the term of this patent subsequent to Jan. 6, 2004 has been disclaimed.

[21] Appl. No.: 883,751

[22] Filed: Jul. 9, 1986

Related U.S. Application Data

[63] Continuation-in-part of Ser. No. 788,336, Oct. 17, 1985, Pat. No. 4,634,834.

[51] Int. Cl.[4] ..... H05B 1/02

[52] U.S. Cl. ..... 219/208; 123/142.5 E; 338/22 R; 374/185; 219/504

[58] Field of Search ..... 339/17 C, 17 E, 190 P; 219/205, 208, 504, 505; 338/22 R, 23, 220; 123/142.5 E, 142.5 R; 337/180, 181; 374/185

[56] References Cited

U.S. PATENT DOCUMENTS

| | | | |
|---|---|---|---|
| 1,727,881 | 9/1929 | Hoyt | 219/335 |
| 3,031,565 | 4/1962 | Appleton et al. | 219/441 |
| 3,148,268 | 9/1964 | Heinbuch | 219/205 |
| 3,646,314 | 2/1972 | Windsor | 219/208 |
| 3,728,660 | 4/1973 | Finney | 338/23 X |
| 3,790,858 | 2/1974 | Brancaleone et al. | 339/193 P X |
| 3,896,289 | 7/1975 | Di Renna | 219/523 |
| 3,943,325 | 3/1976 | Pickard | 219/208 |
| 3,969,605 | 7/1976 | Danell | 219/208 |
| 4,072,378 | 2/1978 | Lockbrinner et al. | 339/17 C |
| 4,163,963 | 8/1979 | Ryckman, Jr. | 338/22 R |
| 4,282,754 | 8/1981 | Provasnik | 338/22 R |
| 4,442,343 | 4/1984 | Genuit et al. | 219/328 X |
| 4,465,039 | 8/1984 | Snelgrove et al. | 219/208 X |
| 4,501,952 | 2/1985 | Lehrke | 338/22 R X |
| 4,634,834 | 1/1987 | Lupoli et al. | 219/208 |

FOREIGN PATENT DOCUMENTS

| | | | |
|---|---|---|---|
| 512017 | 4/1955 | Canada . | |
| 850765 | 9/1970 | Canada | 219/208 |
| 850767 | 9/1970 | Canada . | |
| 963518 | 2/1975 | Canada . | |
| 1118513 | 2/1982 | Canada . | |
| 123359 | 9/1980 | Japan | 219/208 |
| 161195 | 11/1957 | Sweden | 219/208 |
| 603191 | 6/1948 | United Kingdom | 219/331 |

*Primary Examiner*—Patrick R. Salce
*Assistant Examiner*—Marc S. Hoff
*Attorney, Agent, or Firm*—Mitchell D. Bittman

[57] ABSTRACT

A pre-heater for internal combustion engines, especially adapted for use in cold climates while a vehicle is being stored, parked, or otherwise idle. The heater has a base member that is adapted to be secured in an opening of the engine block, and an electric heating element carried by the base member and exposed to the interior area of the block so as to be in contact with the coolant thereof. Electric terminals carried by the base member are connected to the heating element to effect energization thereof. An electric cable is also provided, having a plug detachable from the base member. The plug has mating terminals cooperable with the electric terminals of the base member to establish an electrical circuit through the heating element. A heat-responsive sensor device is carried by the plug, and monitors the temperature of the base member and heating element in order to effect an automatic control of the energization of the latter.

17 Claims, 24 Drawing Figures

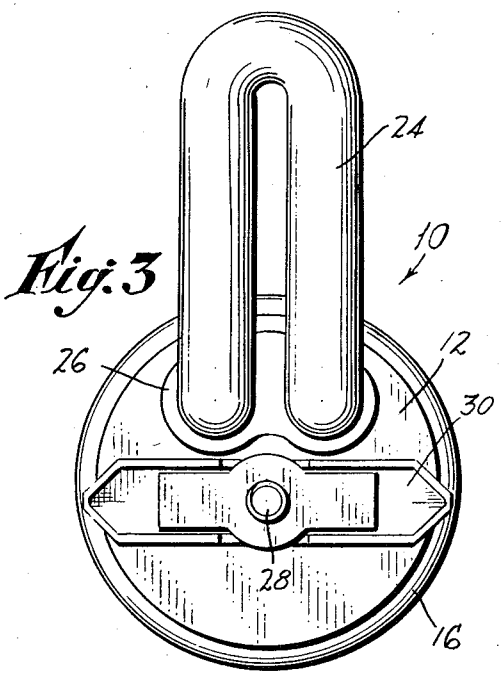
Fig. 3
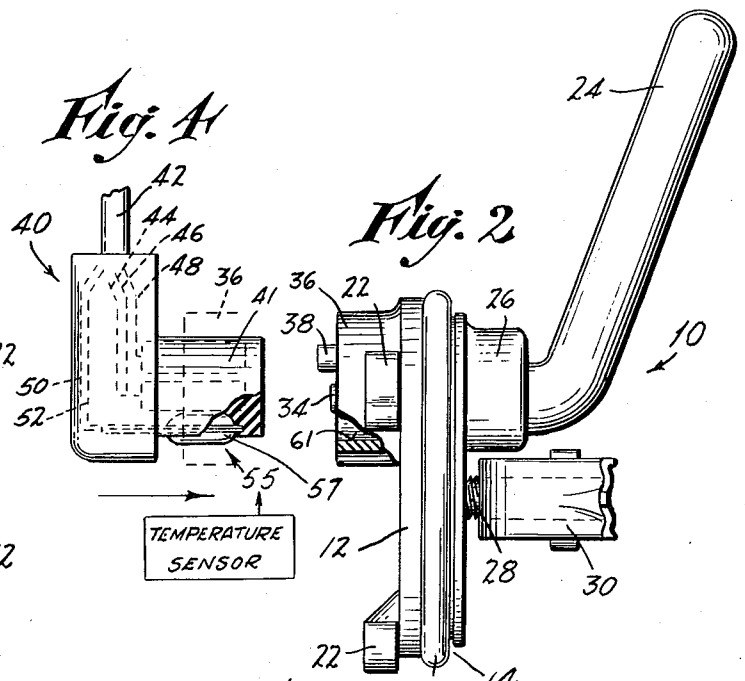
Fig. 2
Fig. 4
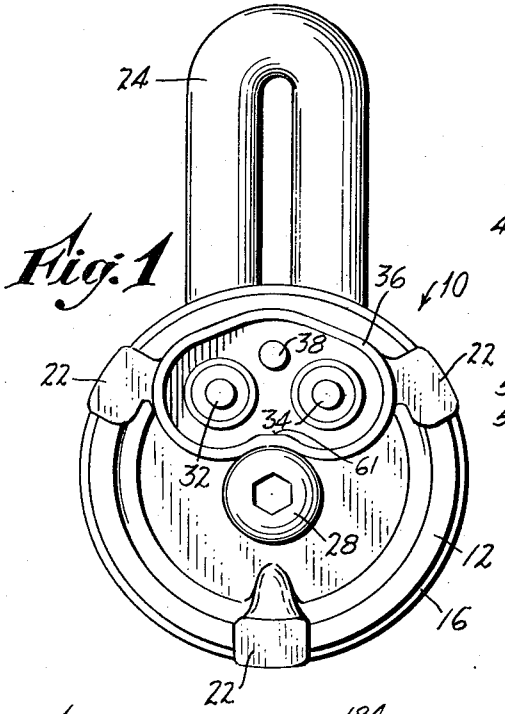
Fig. 1
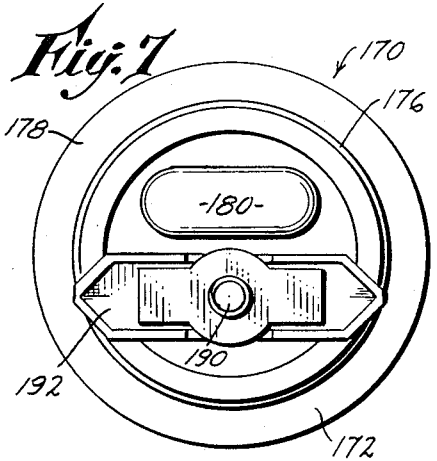
Fig. 7
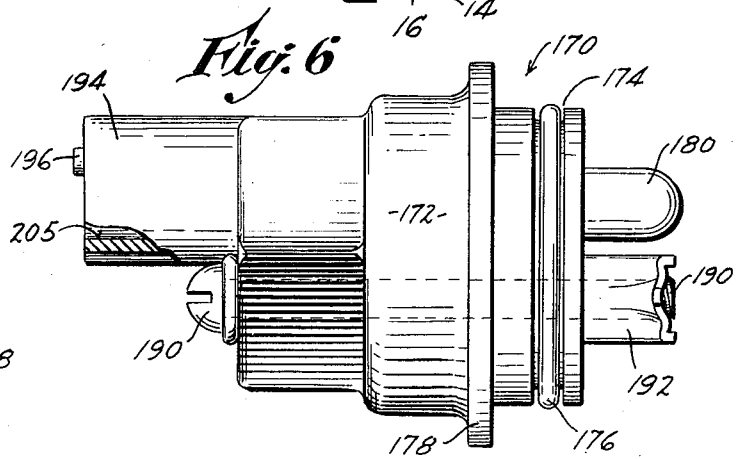
Fig. 6
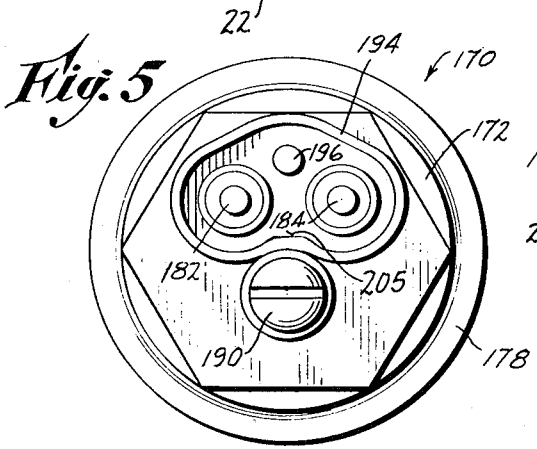
Fig. 5

TEMPERATURE SENSOR
HEATING ELEMENT
120 V.A.C.

PLUG HAVING ENCAPSULATED THERMAL SENSOR, FOR ENGINE BLOCK HEATER

CROSS REFERENCES TO RELATED APPLICATIONS

The present application is a continuation-in-part of our co-pending application, U.S. Ser. No. 788,336 filed Oct. 17, 1985 now U.S. Pat. No. 4,634,834 dated Jan. 6, 1987, and entitled ENGINE BLOCK HEATER.

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to devices for preheating internal combustion engines and more particularly to heaters of the type wherein a housing having a heater element is mounted directly on the engine block.

2. Description of the Related Art Including Information Disclosed Under 37 CFR §§ 1.97–1.99

In the past a number of proposals have been made for minimizing the various problems arising from exposure of motor vehicles to extreme cold. It is well known that vehicles which have been stored, parked or otherwise idle for a period of time are often difficult or impossible to start. A number of factors contribute to this problem. First, the ability of the fuel to be vaporized in the carburetor is greatly diminished. Also, water or water vapors in the fuel lines and carburetor tend to freeze, often creating a plug that can completely block fuel flow. In addition, the oil in the crankcase is considerably more viscous when cold, creating an additional load on the starter motor and electrical system of the vehicle. Moreover, the cranking capacity of a typical storage battery decreases considerably when subjected to unusually low temperatures. And, the reduction in battery voltage adversely affects the intensity of the spark produced by the ignition circuit.

One approach toward solving the problem is the use of a modular heater plug which is installed in a suitable access passage in the engine block. Generally the plug has a heater element protruding into the interior of the block so as to be capable of contact with the coolant therein. When the vehicle is to be stored or parked, the driver merely connects a power cord leading from the plug to a suitable 120 volt power source.

While such devices operated in a generally satisfactory manner, several drawbacks became apparent. First, with water cooled engines it was essential that the level of coolant in the block be sufficient to insure complete immersion of the heater element at all times. Due to the relatively high power associated with such heater devices, typically 400–600 watts, the element could cause permanent damage to itself if sufficient surrounding engine coolant was not available to draw off the heat as it was produced. Moreover, the power consumed was generally maintained constant at this relatively high level, irrespective of the ultimate steady state temperature reached by the block and coolant. That is, no compensation was made for variations in the ambient temperature. Accordingly, continuous application of high power to heater devices of this type over prolonged periods, for example over night or over a weekend, was considered to be both dangerous and wasteful of energy.

Attempts have been made to periodically interrupt the power supplied to a block heater, wherein a control module containing a bimetal switch was strapped onto or otherwise fastened to one of the hoses or lines extending between the block and radiator. This arrangement had several disadvantages, however. In particular, the temperature of the coolant in the hose was not truly representative of that in the engine block, because the vehicle's water pump was not operating while the vehicle was idle. It was considered that any convective flow of the coolant from the block was of little significance as regards monitoring block temperature. Moreover, the use of a bimetal switch had drawbacks in that it was required to control relatively heavy currents, typically on the order of 4 or 5 amperes. Arcing of the contacts occurred, causing eventual degeneration of the same and leading to erratic operation. The life of the switch was thus limited, especially in view of the multiple cycles which would occur over a period of several seasons. As the switch contacts deteriorated, the thermal response of the device changed. That is, it would open and close at temperatures which were different from those initially established during manufacture or calibration. Accordingly it is considered that such devices are of limited utility, especially in environments that are subject to extremes in temperature, as in the present instance where the ranges extend from well below zero, to several hundred degrees Fahrenheit.

In addition, with bimetal switches, spike-like current pulses were generated since the switching point usually did not coincide with a zero crossing of the a. c. wave. Such pulses are constituted of a wide band of frequencies, and caused periodic interference to radio and television reception in the immediate locality surrounding the device.

SUMMARY OF THE INVENTION

The above drawbacks and disadvantages of prior engine block heaters are largely obviated by the present invention, which has for one object the provision of a novel and improved block heater which is simple in construction, and especially reliable and safe in operation, even over extended periods of use.

A related object of the invention is to provide an improved engine block heater as outlined above, which is especially economical to operate and whereby there is eliminated unnecessary waste of energy, through the use of a novel control arrangement.

Still another object of the invention is to provide an improved engine block heater as above characterized wherein there is greatly reduced the generation of spurious signals of a type which would cause radio or television interference.

A still further object of the invention is to provide an improved engine block heater of the kind indicated, wherein a representative indication of the temperature of the heater and heating element associated therewith is provided, and the current supplied to the element is regulated automatically and with a high degree of reliability, so as to minimize or eliminate overheating of the element in the event that the coolant in the engine block is lost, or that its level falls below normal.

Yet another object of the invention is to provide an engine block heater as above set forth, which has unique sealed sensor means in the molded connector plug that is attachable to the heater unit, to the end that improved economies are had in the manufacture while at the same time better and more reliable performance is realized.

A still further object of the invention is to provide an engine block heater of the kind indicated, wherein a sealed sensor is imbedded in one side of a resilient molded rubber plug, and wherein the resilience of the plug biases the sensor into firm engagement with the inner surface of the wall of a hollow boss or skirt on the heater and in which the plug is telescopically received, so as to insure firm engagement between the wall and sensor and provide for maximum transfer of heat from the heater to the sensor.

Yet another object of the invention is to provide an engine block heater as above set forth, wherein a sealed sensor is imbedded in one side of a resilient molded rubber plug, and wherein the sensor protrudes slightly from the surrounding side surface of the plug and provides a sloped leading edge for engagement with the inner surface or walls of a hollow boss or skirt on the heater, thereby minimizing interference between the plug and skirt without sacrificing good heat transfer from the skirt wall to the sensor.

Still another object of the invention is to provide an engine block heater as outlined above, wherein a relatively small electronic temperature sensing component is housed in a protective casing in such a way as to prevent damage thereto from contact with external objects, and also damage resulting from strain applied to the leads of the component from external wires connected therewith.

The above objects are accomplished by the provision of a unique heater accessory for internal combustion engines, comprising a base member having means for attaching it in an opening of an engine block, an electric heater element carried by the base member, said element being exposed to the interior area of the block and being adapted to heat the coolant thereof, and an automatic control including electric terminal and attachment means carried by the member and connected to the element to effect energization thereof.

A supply cable having cooperable terminal and attachment means is connected with the terminal and attachment means of the base member to support the plug and to enable the establishment of an electrical circuit through the said means, and a heat-responsive sensor device is partially imbedded in the plug at its side, and responds to transfer of heat from the terminal and attachment means of the base member, in such a way that there can be provided a control of the energization of the element according to the temperature reached directly at the base member and element.

As a consequence, the power to the element can be varied, as by periodic interruption of the current flow, and there is thus prevented catastrophic overheating of the element; additionally, there is realized a saving in energy over arrangements where a continuously energized heating element is employed. As a consequence, the life of the heater is extended, and hazards associated with overheating are significantly minimized.

The temperature sensor units as provided by the invention are imbedded in the rubber connector plug at the time of molding of the latter, making for a tightly sealed assemblage and one that is resistant to adverse conditions of use and malfunctioning.

The unique mounting for the temperature sensitive component isolates it from damage resulting from contact with external objects; also the mounting prevents excessive strain from being applied to the leads of the component and also prevents the latter from being contacted by molten rubber during the formation of the plug assemblage.

The sensor unit protrudes slightly above the surrounding area of the side of the plug, and has a sloping lead-in surface that facilitates installation of the plug into the skirt of the heater unit. The plug, being resilient rubber, biases the sensor into firm engagement with the wall of the skirt so as to maximize heat transfer to the sensor.

Still other features and advantages will hereinafter appear.

BRIEF DESCRIPTION OF THE DRAWINGS

In the drawings, illustrating several embodiments of the invention:

FIG. 1 is a front elevational view of an engine block heater of a type adapted to be installed in an access passage of the block, this view particularly illustrating the base member of the heater and the electric terminals carried thereby.

FIG. 2 is a side elevational view of the heater of FIG. 1.

FIG. 3 is a rear elevational view of the heater of FIGS. 1 and 2.

FIG. 4 is a fragmentary side elevational view of a power cord and electric plug containing a heat-responsive sensor device which monitors heat generated by the heating element and appearin at the base member.

FIG. 5 is front elevational view of a modified engine block heater employing a somewhat smaller heating element, this constituting another embodiment of the invention.

FIG. 6 is a side elevational view of the heater of FIG. 5.

FIG. 7 is a rear elevational view of the heater of FIGS. 5 and 6.

DESCRIPTION OF THE PREFERRED EMBODIMENT

Figures 8, 9, 10, 11, 12, 13, 14, 15:
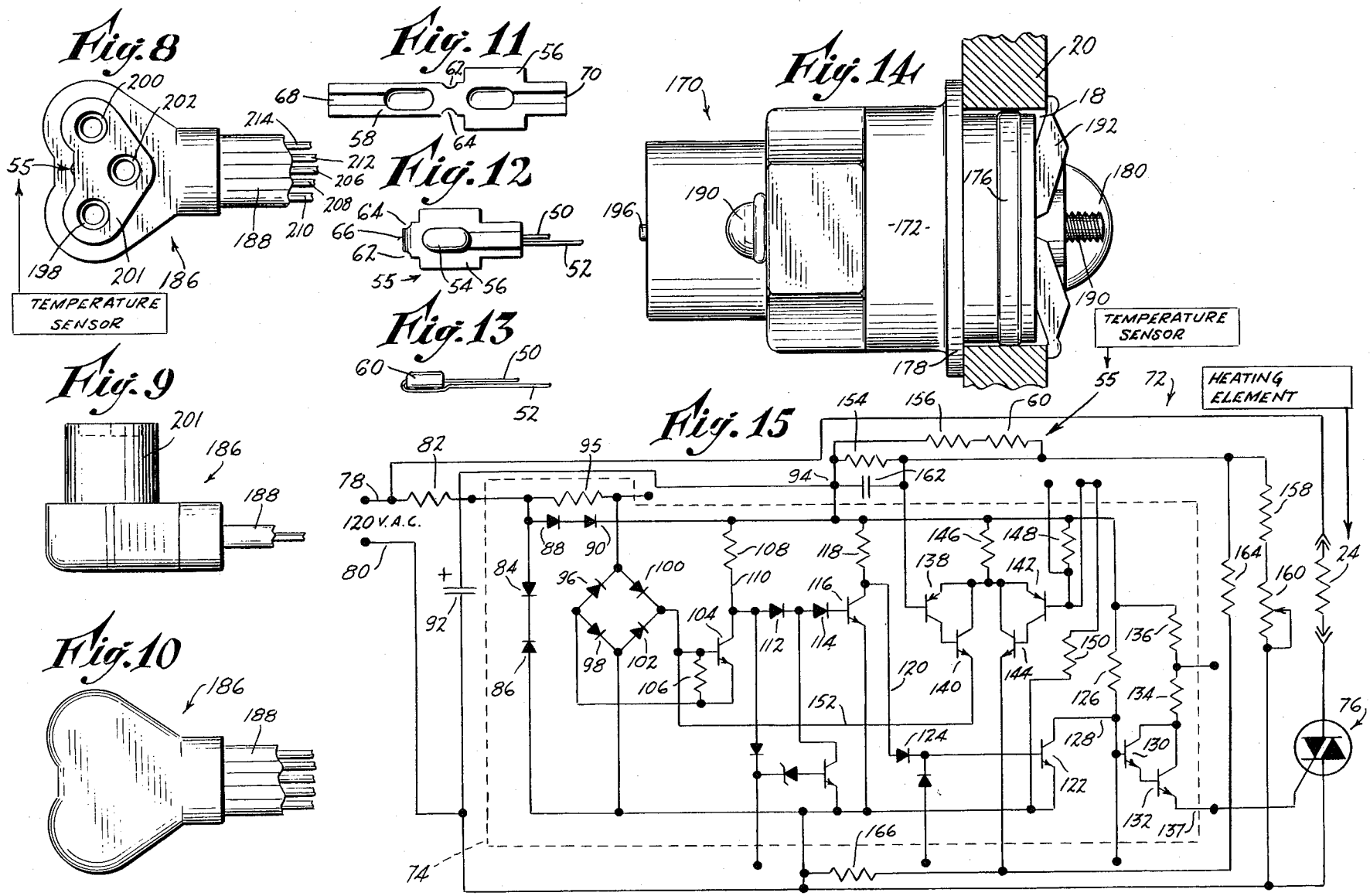
FIG. 8 is a fragmentary rear elevational view of a plug and power/control cord associated therewith, for use with the heater of FIGS. 5–7.
FIG. 9 is a fragmentary side elevational view of the plug and cord of FIG. 8.
FIG. 10 is a fragmentary front elevational view of the plug and cord of FIGS. 8 and 9.
FIG. 11 is a top plan view of a sheet metal stamping prior to its being folded into a jacket or casing for a temperature sensitive element employed with the plugs of the heaters of the present invention.
FIG. 12 is a plan view of the folded stamping, having a portion bent over upon itself so as to form a cavity constituting a jacket for the temperature sensitive element.
FIG. 13 is a side elevational view of the temperature sensitive element of the heat-responsive sensor device of FIG. 12.
FIG. 14 is a top plan view of the heater of FIG. 6, shown mounted in an apertured wall of the water jacket of an internal combustion engine.
FIG. 15 is a schematic circuit diagram of a controller associated with the heat-responsive sensor device, the controller being adapted to receive information from the sensor device and to regulate current supplied to the heating element of one of the block heaters mentioned above.

Referring first to FIGS. 1-3 there is illustrated an engine block heater generally designated by the numeral 10, comprising a base member 12 of disk-like configuration with an annular peripheral groove 14 that is adapted to receive a sealing O-ring 16 for engagement with the circular wall of a hole or opening 18 in the water jacket of the engine block 20, in the manner shown in FIG. 14. In the disclosed construction the base member 12 has three radially extending ears 22 constituting positioning shoulders, which engage the outer surface of the water jacket 20 when the block heater is installed. Projecting upwardly from the rear of the base member is a generally U-shaped metal-clad heating element 24, rigid with the base member 12 and mounted in a crescent-shaped plateau 26 thereof. The heating element 24 comprises a hollow metal tube which is joined to the base member 12, by being sweated into suitable holes therein. The tube contains a heater wire and a high temperature ceramic cement (not shown) which provides both mechanical support for the wire and insulates the latter from the tube. The element 24 is of generally conventional construction. A hole in the center of the base member receives a mounting screw 28, the latter in turn carrying a butterfly nut 30 by which the base member 12 can be retained in position in its mounting hole 18.

The heating element 24 has two electrical terminals 32, 34 particularly illustrated in FIG. 1, by which the element 24 can be energized. The terminals comprise pins which are housed in a rigid encircling wall portion or hollow boss or skirt 36 on the front of the metal base member. The pins 32, 34 are electrically insulated from the base member, as will be understood. An additional pin 38 constitutes a third wire ground, and is electrically connected to the base member 12.

FIG. 4 illustrates a molded rubber electrical plug 40 and integral supply cable or power cord 42, the plug being receivable in the boss 36 of the base member 12, the latter being represented by the dotted outline 36 in FIG. 4. The rubber plug 40 is resilient and has terminal and attachment means in the form of sockets that receive the pins 32 and 34 of the base member 12, and also a third socket that receives the ground terminal or pin 38. The sockets are carried in a boss 41 of the plug 40. The outer surface configuration of the boss 41 is similar to the inner surface contour of the boss 36 such that the boss 41 can be telescopically received therein. In FIG. 4, the cord 42 consists of five leads designated 44, 46, 48, 50 and 52; these are shown in dotted outline in the plug 40. When the plug is installed on the base member 12, the leads 44, 46 are connected respectively to the terminals 32, 34. Lead 48 is connected to the pin 38, and leads 50 and 52 are connected to the temperature sensitive element of a heat-responsive sensor device 55 to be described below.

Referring again to FIGS. 4 and 12, and in accordance with the present invention there is provided a unique control including the heat-responsive sensor device 55 directly carried by the plug 40 and partially embedded therein, for monitoring the temperature of the base member 12 and heating element 24. The sensor device preferably takes the form of a temperature sensitive silicon element 60 (FIG. 13) housed in a metal jacket 54, particularly shown in FIG. 12, the jacket comprising two portions or halves that are folded over one another. Each portion has a hollow wall 56, 58, and when they overlie as in FIG. 12, there is defined a cavity in which the temperature sensitive element 60 is received. The leads of the element 60 are shown in FIG. 12, and as noted above are designated 50, 52 respectively. Where the jacket 54 is constituted of conductive material, the leads are provided with suitable insulation such as heat-resistant rubber tubing or sleeving, commonly known as "spaghetti". This prevents short circuiting of the leads to one another, and to the jacket 54. The leads 50, 52 in turn extend to a controller, to be described below.

Again as shown in FIG. 4, one side of the jacket 54 is disposed and exposed at the surface of the plug 40, which is preferably of heat-resistant molded rubber or plastic substance, and such jacket is intended to physically contact the inner surface of the rigid boss 36 of the base member 12 so as to be in good pressurized thermal contact therewith. The heat-responsive sensor device 55 thus receives heat from the base member by both conduction and radiation. The inner surface of the rigid boss has a flat portion, indicated at 61, against which the jacket 54 bears under pressure when the plug 40 is installed. To facilitate installation of the plug 40 into the boss 36, the jacket 54 of the sensor device 55 is formed so as to present a sloped leading surface 57 for initial contact with the surface 61, providing an interference fit in the boss 36. The plug 40 is thereby frictionally pressed into and held in the boss 36. Heat from the boss 36 is quickly transferred to the jacket 54, and thereafter to the temperature sensitive element 60. It has been discovered that the temperature of the boss 36 of the base member 12 closely follows that appearing at the solder joints between the metal base member 12 and the metal heating element 24, and thus the temperature measured by the temperature sensitive element 60 at the boss or skirt 36 is truly representative of that at the said joints.

Referring again to FIGS. 11 and 12, the jacket 54 can be constituted of copper, brass, steel or other thermally conductive material, and manufactured as a metal stamping. The hollow walls are preferably formed at the time of stamping, as are two crescent-shaped cutouts 62, 64 defining a line of weakness 66 along which the bend can be made, to form the assemblage of FIG. 12. Optionally, a thin layer or sleeve of heat-conducting, insulating material is placed over the temperature sensitive element 60 prior to its insertion in the jacket 54, to insulate it therefrom electrically and to serve as a cushion and prevent mechanical vibration or shock from damaging the temperature sensitive element 60, and to promore heat conduction. Disposed along the stamping are two elongate clearance grooves 68, 70, which provide room for the leads 50, 52 of the temperature sensitive element 60, in the manner of FIGS. 11 and 12.

An electronic feedback-type controller for the heating element 24 is illustrated in FIG. 15, and designated generally 72. This figure comprises a schematic diagram of an integrated circuit amplifier and driver 74, the latter in turn being connected to drive the gate of a thyristor, such as a triac 76. The triac is in series with the heating element 24, shown diagrammatically in this figure as a resistor. In operation, the controller 72 receives an indication of the temperature of the base member 12 and heating element 24 from the temperature sensitive element 60, and depending on the magnitude sensed, either switches the triac 76 on or enables it to turn off, thereby interrupting the current drawn by the heating element 24.

In FIG. 15, the portion of the schematic indicated in dotted outline is the integrated circuit 74; it is completely self-contained in its own package. In the present instance, the integrated circuit that has been employed is a type CA3059, known as a Zero-Voltage Switch, manufactured by RCA. Description of this unit is provided in a brochure available from RCA and entitled, "Application Note ICAN-6158". The disclosure of this publication is hereby specifically incorporated in the present specification. Other equivalent types of integrated circuits could be substituted for this unit. For example, a type CA3079, also manufactured by RCA, could be employed.

In FIG. 15, the lines indicated 78, 80 are connected through a conventional power plug (not shown), to a source of 120 volts a. c. Resistor 82 drops the voltage to a lower value, typically plus and minus 8 volts, as determined by a clipping circuit comprising diodes 84, 86. Diodes 88, 90 rectify this voltage and convert it to d. c. Capacitor 92 filters the resultant d. c., which is impressed across the terminals indicated 94, 80. The line 80 can be considered to be "common" wherein the line 94 is a positive d. c. supply line for powering amplifier and switching circuitry to be described below.

The a. c. at the junction of resistor 82 and diode 84 is then applied, through resistor 95, to four diodes 96, 98, 100, 102 arranged in a full wave bridge circuit, which together with transistor 104 and resistors 106 and 108, constitute a zero-voltage threshold detector. This circuit generates a positive-going output pulse on line 110 during each passage of the a. c. line voltage through zero. The output on line 110 is coupled through diodes 112, 114 to a second transistor 116, having a load resistor 118. Output on line 120 from this second transistor 116 drives an inverter stage 122 through diode 124. The load resistor is designated 126. Output on line 128 in turn is employed to drive a Darlington amplifier comprising transistors 130, 132 having load resistors 134, 136, and an output line 137.

The integrated circuit 74 also includes a differential amplifier comprising transistors 138, 140, 142 and 144, and resistor 146. The differential amplifier functions as a voltage comparator, wherein a reference voltage applied to one input, that of transistor 142, is compared with a voltage derived from a second divider which includes the resistance of the temperature sensitive element 60. In particular, a d. c. bias is applied to the base of transistor 142 by the voltage divider formed by resistors 148 and 150, and output from the differential amplifier is taken off the emitter of transistor 140, and applied to the base of transistor 104 through line 152. The transistor 138 is fed from a second divider string which includes resistors 154, 156, 158 and 160, and also containing the temperature sensitive element 60. In the present instance, the temperature sensitive element has a positive temperature coefficient characteristic. Capacitor 162 constitutes a filter which reduces the sensitivity of the amplifier to spikes or incidental noise that might otherwise appear on the base of transistor 138. Resistor 160 is adjustable in order to permit setting the operating point of the differential amplifier, to achieve the desired operation.

Hysteresis is optionally added to the circuit by the resistors 164, 166, which supply positive feedback to the differential amplifier, as will be described below.

The output of the second Darlington transistor 132 is connected directly to the gate of the triac 76 that is in series with the heating element 24 of the block heater. The heating element is shown in FIG. 15 connected between one side 78 of the 120 volt a. c. line and one terminal of the triac 76.

In operation of the circuit of FIG. 15, the zero-crossing detector functions in such a way that the triac 76 can be switched on only during a time interval when the a. c. voltage applied to the series connection of the triac 76 and heating element 24 is at or near zero (actually, within plus or minus 2.1 volts of zero, which is the drop sustained across two of the diodes in the full wave bridge 96–102, added to the drop across the base-emitter junction of transistor 104). When the instantaneous value of the a. c. voltage lies outside of this range, the base of transistor 104 receives drive and conducts, turning off transistor 116. In turn, transistor 122 is turned on through diode 124. Base drive to transistor 130 of the Darlington pair is thus absent, and no output signal appears on line 137. Accordingly, the gate of the triac receives no drive, and no current flows through the heating element 24, regardless of the condition of the differential amplifier 138, 140, 142, 144.

The differential amplifier is arranged such that when the temperature of the temperature sensitive element 60 is low, transistors 138, 140 are off. As mentioned above, fixed bias is applied to transistors 142, 144 by resistors 148, 150. Adjustable resistor 160 has been set such that at temperatures below that at which it is desired that the heating element be energized, and where the resistance of the temperature sensitive element 60 is relatively low, the bias applied to the base of transistor 138 is insufficient to turn it and the following transistor 140 on. As a consequence, the emitter of transistor 140 applies no drive to the base of transistor 104. However, this transistor 104 is switched on for most of the a. c. cycle, but is switched off during zero-crossing points, when the bridge comprising diodes 96, 98, 100 and 102 momentarily interrupts its drive current. During this zero-crossing point, where transistor 104 has no base drive, transistor 116 is turned on, transistor 122 is turned off, and the Darlington pair 130, 132 receives base drive, thus triggering the triac 76, through line 137, into conduction, beginning at a zero-crossing point of the wave. The triac remains conducting for one-half cycle, even though the gate signal is a pulse which disappears a short time after the onset of triggering. Current thus flows through the heating element 24. Near the end of this half cycle, when the triac 76 would cease conducting in the absence of gate current, transistor 104 momentarily turns off again, causing another pulse to appear at the gate of the triac. The latter thus continues to conduct for another half cycle, and so on, as long as there is no voltage applied to the base of transistor 104, through line 152 from the emitter of transistor 140.

When the temperature of the block heater rises above a predetermined value corresponding to that at which it is desired to, interrupt current to the heating element, temperature sensitive element 60 will experience an increase in its resistance sufficient to cause the base-emitter voltage of transistor 138 to increase to the point where base current flows, and transistor 138 conducts. The emitter voltage on transistor 140 rises, and current is supplied to the base of transistor 104. This transistor 104 is thus no longer solely under the control of signals received from the bridge circuit 96, 98, 100, 102. Transistor 116 is switched off, while transistor 122 is turned on. This reduces the voltage on the base of the Darlington pair 130, 132 to a low value, which removes gate drive from the triac 76, rendering it non-conductive at the next zero-crossing point of the applied a. c. wave and thereby shutting off current through the heating element 24. Resistors 164, 166 form a voltage divider between the common line 80 and a junction point whose voltage is influenced by the value of resistance assumed by the temperature sensitive element 60. The effect of this connection is to provide hysteresis to the circuit, and thus prevent the occurrence of a condition termed "half-cycling", which results from the uncertainty of the state of the differential amplifier 138, 140, 42, 144 when the latter is at or near a "balanced" condition, i.e. where the absolute values of the voltages being applied to the bases of transistors 138 and 142 are nearly equal. This point can be set by adjustment of resistor 160. The addition of the resistors 164, 166 creates an artificial avalanche effect at the switching point, and thus eliminates the possibility of the heating element current being switched on and off many times during a short interval when the block temperature is at or near a threshold value.

After an indeterminate time interval has elapsed where perhaps the engine block has cooled once again, the resistance of the temperature sensitive element 60 decreases, whereby there is again insufficient drive for transistor 138. This causes the drive voltage on the emitter of transistor 140 to drop, and transistor 104 once again begins periodic switching on and off at the zero crossing points, which in turn provides the desired pulses to the gate of the triac 76 at these points and enables the triac to conduct continuously. Current thus flows through the heating element 24 once again, and the temperature of the block heater begins to rise unless the ambient temperature is falling so fast as to draw off heat from the block at a rate greater than it can be supplied to the heating element.

Of course it will be understood that if the ambient temperature is extremely low, the resistance of the temperature sensitive element 60 may remain sufficiently low that the transistor 138 never receives sufficient base drive to conduct. In such a case, the heating element 24 remains energized continuously, thereby imparting maximum heat to the block. The parameters of the heating element can be chosen to provide the desired heating capacity, depending on the size of the engine, and the temperature or climatic conditions that are applicable to a particular region.

In FIG. 15 the components of the integrated circuit which have not been labelled are not actively involved in the operation of the circuit, and accordingly their specific functions have not been discussed. In addition, those terminals of the controller shown as having no external connection thereto are similarly not involved.

Yet another embodiment of the invention is shown in FIGS. 5–10 and 14, illustrating a modified engine block heater generally designated 170 comprising a base member 172 having a cylindrical body portion with an annular groove 174 that is adapted to receive a sealing O-ring 176 for engagement with the annular walls of an access hole or opening 18, FIG. 14, in the water jacket of the engine block. The base member 172 has an annular positioning and stop shoulder 178 which engages the outer surface of the jacket 20 when the block heater is installed. As in the previous embodiment, there is provided a generally U-shaped heating element 180 having two electric terminals 182, 184, FIG. 5, for connection with a plug 186 and power cord 188 to be described below. A hole in the center of the base member 170 receives a mounting screw 190, the latter in turn carrying a butterfly nut 192 by which the base member 172 can be retained in position in its mounting hole as in FIG. 14. The two heating element terminals comprising pins 182, 184 are disposed in a rigid hollow boss or skirt 194 on the front of the member 172. A third pin 196 constitutes a ground, and is electrically connected to the remainder of the base member 172. The construction of the heating element 180 is similar to that of the corresponding heating element 24 of the first embodiment. The element comprises a hollow U-shaped tube that is sweated into the metal base member 172. Disposed within the tube is a heater wire (not shown) and the wire is mechanically secured by ceramic cement or other heat-resistant substance. Electrical connections to the heating wire are made through the terminals 182, 184 as can be readily understood.

The molded rubber electrical plug 186 and power cord 188 associated with the heater 170 are generally similar to the plug 40 and cord 42, and are particularly shown in FIGS. 8–10. The plug has terminal and attachment means in the form of sockets 198, 200 carried by a boss 201, said sockets receiving the pins of 182, 184 respectively the base member 172. The boss 201 also has a third socket 202 that receives the ground terminal or pin 196.

Referring again to the figures and by the present invention there is provided the novel heat-responsive sensor device 55 directly carried by the plug 186 and partially embedded therein. The sensor device includes a temperature sensitive element 60 as described in connection with the first-mentioned embodiment, which is housed in the metal jacket 54 having the two wall portions 56, 58 which are folded over one another. Each wall portion is hollow, and when they overlie as in FIG. 12, there is defined a cavity in which the temperature sensitive element 60 is received. The leads of the temperature sensitive element, shown in FIG. 12, are provided with suitable insulation such as plastic or rubber tubing, or sleeving (not shown), to prevent short circuiting thereof.

In FIGS. 5 and 8, the outer surface of the jacket 54 adjacent one of its hollow walls emerges or protrudes slightly from the surface of the plug 186, so as to physically contact the flat 205 on the inner surface of the rigid boss 194 of the base member 172 and be in good thermal contact therewith. Heat from the boss 194 is quickly transferred to the jacket 54, and thereafter to the temperature sensitive element 60 when the plug 186 is installed. In addition to the two power-carrying leads 206, 208 of the cord 188 which connect with sockets 198, 200 respectively, and the ground lead 210 thereof, two additional leads 212, 214 extend along the cord and are connected with the temperature sensitive element 60. The opposite ends of leads 212, 214 extend to the controller 72 which has been described above in connection with FIG. 15.

As can be readily understood, if the block heater of FIGS. 5–7 and 14 is to be substituted for that shown in FIGS. 1–3, the heating element 180 would be connected in the circuit of FIG. 15 in place of the element 24, and the remaining connections as regards the temperature sensitive element 60 would remain the same. In use, the heater 170 would be permanently installed on the engine block. The plug 186 is removable from the receptacle comprising the boss 194 and pins 182, 184 and 196, for purposes of storage, as might be desired during warm weather.

When it was desired to operate the unit, the user merely connects the plug 186 to the heater base member 172 and installs the conventional 120 volt plug (not shown) that leads to the lines 78, 80 of FIG. 15, into a suitable 120 volt electrical receptacle at the facility where the vehicle was to be parked or stored. Depending on the rate at which the engine block temperature fell, the heating element 180 would be automatically energized as required, and would thereby transfer heat to the block and its coolant at the desired rate.

With respect to the various components shown in FIG. 15, the following values have been found to provide satisfactory results, but are given here as examples only, and are not to be construed as being the only values which will provide an operative system. Resistor 82 has a value of approximately 10,000 ohms, 2 watts; resistor 154 is 22,000 ohms; resistor 156 is 2200 ohms; resistor 158 is 4,700 ohms; resistor 160 is 2,000 ohms; resistor 164 is 12,000 ohms; and resistor 166 is 12,000 ohms.

Capacitor 92 has a value of 100 uF, with a voltage rating of 16 volts or more. Capacitor 162 is 0.001 6l uF.

Triac 76 is a type 2N6342A. Device 60 is a type 2K-302K, known by the name Tempsistor (a trademark), manufactured by Midwest Components, Inc., 1981 Port City Blvd., Muskegon, Mich. As an example, at 25° C., the resistance of the device 60 is approximately 3000 ohms, whereas at 75° C., it rises to approximately 4230 ohms, and at 100° C., it is typically 4890 ohms. This device is a P-doped silicon material housed in a glass envelope. The doping level can be varied during manufacture, to achieve desired resistance. In this particular unit, the resistance/temperature relationship is linear, and the device exhibits a positive temperature coefficient. An equivalent unit could be substituted for that designated, as can be readily understood.

Figure 16:
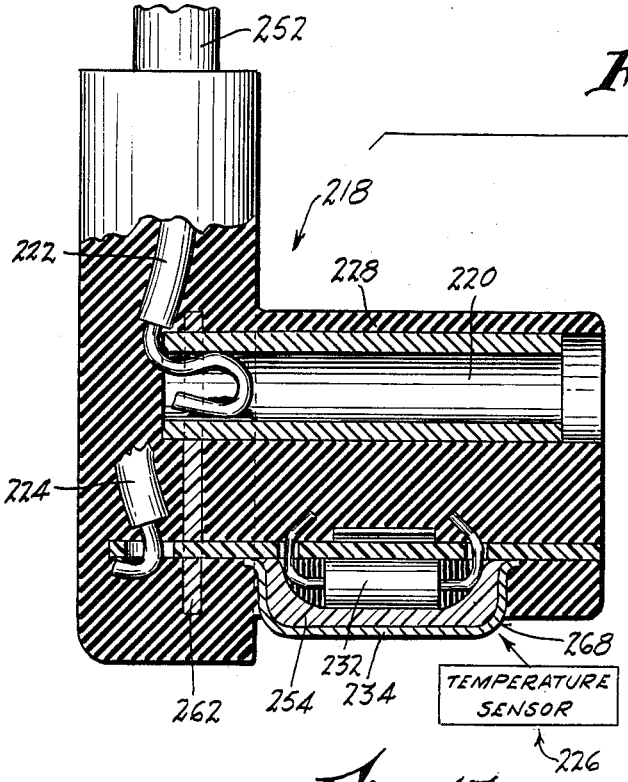
FIG. 16 is an exploded view of an engine block heater according to the invention, showing the connector plug partially in axial section and containing an encapsulated temperature sensor unit of different construction.
Figure 17:
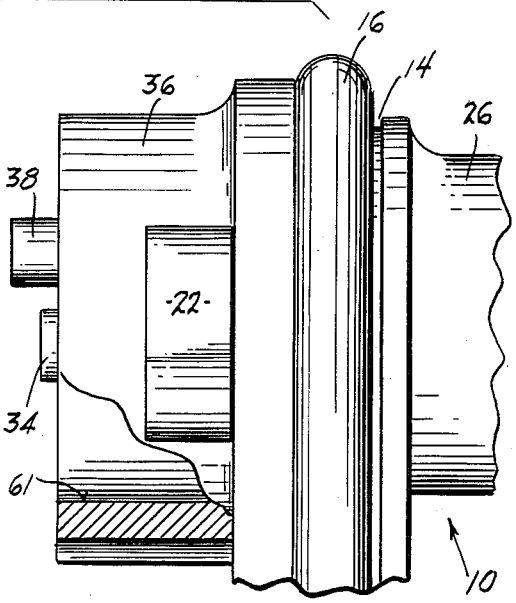
FIG. 17 is a bottom plan view of the temperature sensor unit contained in the plug of FIG. 16.
Figure 17:
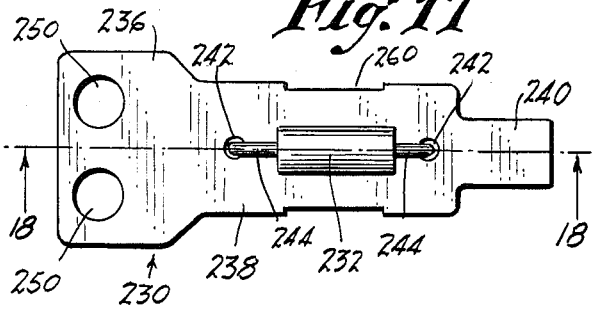
Figure 19:
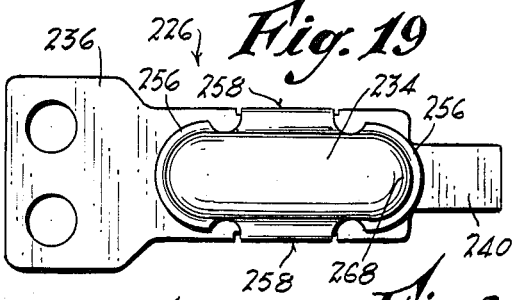
FIG. 19 is a bottom plan view of the entire sensor unit as embodied in the plug of FIG. 17.
Figure 18:
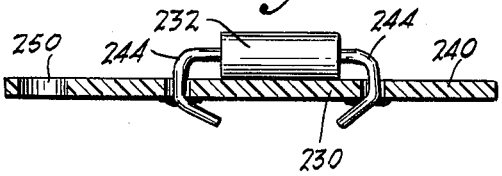
FIG. 18 is a longitudinal sectional view of the sensor unit of FIG. 17 but with a cover piece removed, taken on the line 18—18 of FIG. 17.
Figure 21:
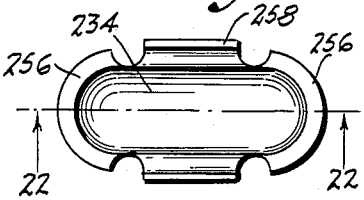
FIG. 21 is a top plan view of the cover piece of the sensor unit of FIGS. 19 and 20.
Figure 24:
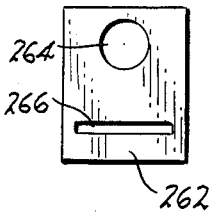
FIG. 24 is a plan view of a phenolic spacer strip as utilized for placement of components during the molding of the plug.

According to this invention there is provided, as illustrated in FIGS. 16–24, a unique encapsulated temperature sensor construction in a molded rubber connector plug, which is of improved efficiency and reduced cost. The plug 218 shown in FIG. 16 is cooperable with the engine block heater 10 in a manner similar to that of the plug 40 already described above. The plug 218 has sockets to receive the pins, including those numbered 34 and 38, of the heater; one such socket (the ground) is designated 220 and is shown connected to a cable ground wire 222 as by solder, in the conventional manner.

The plug 218 has sensing cable wires one of which is indicated by the numeral 224. By the invention, for attachment to such sensing cable wires there is provided a sensing type printed circuit board assemblage 226 which is imbedded in the boss portion 228 of the plug 218 at the time that the latter is being molded. The sensor assemblage 226 is formed essentially of three components, a printed circuit board 230, a heat-responsive sensing element 232 and a metal jacket or thermally conductive casing 234. The PC board 230 is elongate, having a wide, apertured terminal-accommodating end portion 236, a narrower body portion 238 and a still narrower tail portion 240.

Figure 20:
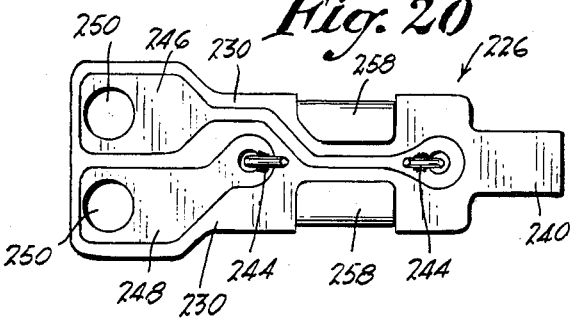
FIG. 20 is a top plan view of the entire sensor unit of FIG. 19.
Figure 22:
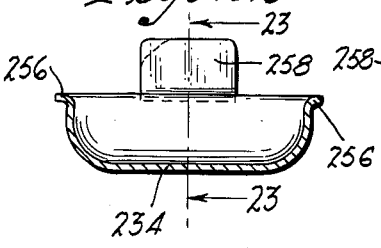
FIG. 22 is a section taken on the line 22—22 of FIG. 21.
Figure 23:
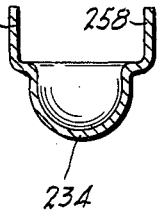
FIG. 23 is a section taken on the line 23—23 of FIG. 22.

The body portion 238 of the PC board has two lead-wire holes 242 through which there extend lead wires 244 of the sensing element 232. As seen in FIG. 20, the PC board has metal conductive strips or tracks 246 and 248 which respectively encircle the holes 242 and also encircle larger apertures 250 in the board, adapted to accommodate cable wires such as the wire 224 seen in FIG. 16. The leads from the sensing element 232 are soldered respectively to the conductive strips 246 and 248, which are in turn soldered to wires in the power cord, designated 252.

The sensing element 232, which can be of silicon composition, is enclosed by the elongate metal shell or jacket 234 and is separated therefrom by a silicone liner 254. The jacket 234 has end flanges 256 which engage the underside of the PC board, and has side tabs 258 which are folded over the top of the board as seen in FIG. 20. The tabs 258 are accommodated in wide notches 260 in the board, to properly position the jacket 234.

A spacer strip 262 of phenolic material, having apertures 264 and 266 to receive the socket 220 and PC board 230 respectively, aid in the placement of the same in the molding cavity at the time that the plug 218 is molded.

The jacket 234 presents a sloping surface 268 to the cooperable flat surface 61 of the boss 36 at the time that the plug 218 is being applied to the heater unit, thereby to facilitate the entry of the plug boss 228 into the boss 36 of the heater.

The construction of FIGS. 16–24 has the following important advantages. The element 232 can be soldered into the PC board by conventional wave soldering techniques, thus simplifying manufacturing, and providing a reliable electrical connection to such leads without the possibility of excessive strain being applied thereto. Stated differently, any strain applied from the wires 224 is taken up by the PC board and not the element.

With this construction, the element 232 is completely enclosed and protected against physical damage. The ears or tabs 258 hold the cover in place, which together with the board, completely surround the element. Also, the thermally conductive layer 254 has the advantage of providing good heat transfer between the cover and the element.

Finally, the mounting arrangement involving the PC board greatly simplifies making electrical connections to the element, as compared to the arrangements shown in the previous embodiments. The PC board provides a convenient means of holding the element and its connecting wires in position while the molding of the plug is occurring. The PC board and casing substantially completely enclose the element so as to prevent molten substance from contacting the same, during formation of the plug. Positioning of the PC board and its casing is also facilitated by use of the phenolic strip of FIG. 24.

Since the circuit (FIG. 15) containing the element 232 is not isolated from the power line (120 VAC) by a transformer, it is considered important that the cover 234 be electrically isolated from the entire control circuit, including the element 232. As seen in FIG. 20, this is accomplished by the layout of the circuit board wherein electrically insulating areas thereof are engaged by the tabs 258 of the cover. As a consequence, the cover is electrically floating and thus presents no shock hazard to personnel handling the plug while the circuitry of FIG. 15 is energized.

The plug, being resilient, enables the cover or casing 234 (and the PC board 230) to yield or retract just slightly into the plug body when the plug is installed, whereby a continuous biasing force will be applied to the casing 234 by the inner surface 61 of the wall of the skirt 36. Good thermal contact between the casing and wall surface is thus facilitated, while there is still maintained electrical isolation of the casing 234. The force applied by the plug to the casing is counter-balanced by transaxial forces applied by the pins of the heater to the sockets or receptacles of the plug, as can be readily understood. The casing is thus sandwiched between the skirt wall and the bulk of the plug body. No external springs or fasteners are required in order to retain the plug and its sensor device in their proper positions.

From the above it can be seen that we have provided novel engine block heaters which are both simple in construction and especially safe and reliable over extended periods of use. Potential problems that might otherwise be encountered with overheating of the unit are completely eliminated. In the event that the level of coolant in the block falls below that of the heating element, the heat-responsive sensor device and controller will automatically detect the condition and periodically interrupt the power supplied to the heating element in order to insure that the temperature reached does not exceed safe levels. In addition, considerable saving in power is realizeable as compared to prior units where the heating element was continuously energized at its maximum power level. The devices of the present invention are thus seen to represent a distinct advance and improvement in the field of block heaters for internal combustion engines.

Each and every one of the appended claims defines an aspect of the invention which is separate and distinct from all others, and accordingly each claim is intended to be treated in this manner when examined in the light of the prior art devices in any determination of novelty or validity.

Variations and modifications are possible without departing from the spirit of the invention.

What is claimed is:

1. As a new article of manufacture, a thermal sensor device attachable to and detachable from a cooperable electrical fitting, comprising in combination:

(a) a line cord constituted of plastics substance, said line cord having at least one electrical conductor embedded in it, (b) a plug fitting on said line cord, formed integral therewith, (c) a thermal sensor unit having electrical lead means connected with said electrical conductor, (d) means encapsulating said sensor unit, (e) said encapsulated sensor unit being imbedded in said plug fitting, (f) a portion of said encapsulating means projecting from and being exposed at the exterior of said plug fitting, (g) said exposed portion of the encapsulating means being adapted to receive heat from said cooperable fitting when said plug fitting is attached thereto.

2. A thermal sensor construction comprising, in combination:

(a) an electrical fitting, (b) a line cord constituted of plastics substance, said line cord having at least one electrical conductor embedded in it, (c) a plug fitting on said line cord, formed integral therewith, said plug fitting being cooperable with said electrical fitting, (d) a thermal sensor unit having electrical lead means connected with said electrical conductor, (e) means encapsulating said sensor unit, (f) said encapsulated sensor unit being imbedded in said plug fitting, (g) a portion of said encapsulating means projecting from and being exposed at the exterior of said plug fitting, (h) said plug fitting being attached to said electrical fitting and the exposed portion of said encapsulating means contacting said electrical fitting and receiving heat from said electrical fitting.

3. A thermal sensor device as set forth in claim 1, wherein:

(a) said encapsulating means includes a flat wall comprising a printed circuit board having circuit elements.

4. A thermal sensor device as set forth in claim 3, wherein:

(a) a circuit element of said printed circuit board is connected with said conductor in the line cord.

5. A thermal sensor device as set forth in claim 3, wherein:

(a) said line cord has an additional electrical conductor, b) said electrical conductors being connected with circuit elements on said printed circuit board.

6. A thermal sensor device as set forth in claim 1, wherein:

(a) said encapsulating means includes a flat wall comprising a printed circuit board, and a shell attached to one side of said board.

7. A thermal sensor device as set forth in claim 6, and further including:

(a) a resilient filler member disposed in said encapsulating means and engaged with said sensor element and shell.

8. A thermal sensor device as set forth in claim 6, wherein:

(a) said shell has attachment tabs, (b) said printed circuit board having cut-out portions accommodating said tabs.

9. A thermal sensor device as set forth in claim 1, wherein:

(a) said sensor line cord has a plurality of conductors connected with said sensor element.

10. A thermal sensor device as set forth in claim 9, wherein:

(a) said plug is constituted as a receptac1e.

11. A plug for connection to terminals of an engine block heater of the type having electrical connector pins surrounded by a skirt carried by the heater, said skirt having a side wall, said plug comprising in combination:

(a) a molded plug body constituted of resilient rubber-like material;

(b) said plug body being telescopically receivable in the skirt of the heater, and having sockets adapted to mate with and receive the connector pins respectively of the heater when the plug is installed thereon, (c) said plug body having a thermal sensor unit comprising a thermally conductive casing, a portion of which is imbedded in the side of the plug body and retained thereby, and another portion of which is exposed and which protrudes above the surrounding surface of the plug body, (d) the resilience of the plug body being adapted to bias the conductive casing into firm engagement with the inner surface of the side wall of the skirt of the heater when the plug body is installed therein, thereby establishing good thermal contact between said side eall and said casing.

12. A plug for connection to terminals of an engine block heater of the type having electrical connector pins surrounded by a skirt carried by the heater, said skirt having a side wall, said plug comprising in combination:

(a) a molded plug body constituted of resilient rubber-like material, (b) said plug being adapted to be telescopically received in the skirt of the heater, and having sockets adapted to mate with and receive the connector pins respectively of the heater when the plug body is installed thereon, (c) said plug body having a thermal sensor unit comprising a thermally conductive casing, a portion of which is imbedded in the side of the plug body and retained thereby, and another portion of which is exposed and which protrudes above the surrounding surface of the plug body, (d) said imbedded casing being retractable into the plug body, within limits, as a consequence of force applied to the casing when the plug is installed on said heater, said force being applied by the inner wall surface of the side wall of the skirt of the heater and being counteracted by corresponding transaxial forces applied by the connector pins of the heater on the sockets carried by the plug body when the latter is installed.

13. An electrical line plug for connection to a heater assembly having electrical terminals, said plug comprising in combination:

(a) a molded plug body constituted of electrically insulating material, (b) receptacles on said body adapted to mate with the terminals respectively, of the heater assembly, (c) a circuit board carried in said plug body and having at least a portion thereof completely imbedded therein, (d) an electrical component mounted on said circuit board, and (e) a cover secured to said circuit board, said cover with said board completely enclosing said electrical component so as to isolate the latter from molten substance and prevent such substance from contacting the said component during molding of the plug body.

14. The invention as set forth in claim 13, wherein:

(a) said cover is constituted as a metal stamping, having means for securing it to the circuit board.

15. The invention as set forth in claim 1, wherein:

(a) said cover has a portion which protrudes from the surface of the said plug body, so as to be accessible from the exterior of the same for enabling transfer of heat to the said component.

16. An electrical line plug for connection to a heater assembly having electrical terminals, said plug comprising in combination:

(a) a molded plug body constituted of electrically insulating material, (b) receptacles on said body adapted to mate with the terminals respectively, of the heater assembly, (c) an electrical component carried in said plug body, and means in said body for making electrical connections thereto, (d) an electrically conductive cover having one portion imbedded in said plug body, and having another portion projecting above the surface of said plug body, and (e) spacer means on the plug body for retaining the cover in fixed position adjacent to but electrically insulated from said electrical oomponent, so as to electrically isolate the cover from the component and thereby eliminate the possibility of shock hazzard to personnel handling the plug and coming in contact with the said cover.

17. the invention as set forth in claim 16, wherein:

(a) said spacer means comprises a printed circuit board having electrically insulating support areas engaging said cover.

* * * * *